US006564774B2

(12) United States Patent
Ellims et al.

(10) Patent No.: US 6,564,774 B2
(45) Date of Patent: May 20, 2003

(54) FEEDFORWARD ENGINE CONTROL GOVERNING SYSTEM

(75) Inventors: Michael Ellims, Oakington (GB); James R. Zurlo, Shorewood, WI (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 09/834,200

(22) Filed: Apr. 12, 2001

(65) Prior Publication Data

US 2002/0148438 A1 Oct. 17, 2002

(51) Int. Cl.[7] ..... F02D 41/14
(52) U.S. Cl. ..... 123/352; 123/361
(58) Field of Search ..... 122/339.16, 339.17, 122/339.18, 339.2, 339.21, 350, 352, 361, 399

(56) References Cited

U.S. PATENT DOCUMENTS

| | | | | |
|---|---|---|---|---|
| 4,419,729 A | * | 12/1983 | Krieder | 123/352 X |
| 4,625,281 A | * | 11/1986 | Deutsch | 123/339.16 X |
| 4,724,810 A | * | 2/1988 | Poirier et al. | 123/339.16 |
| 4,829,438 A | * | 5/1989 | Etoh | 123/352 X |
| 4,862,851 A | | 9/1989 | Washino et al. | 123/339.11 |
| 4,870,584 A | * | 9/1989 | Etoh et al. | 123/349 X |
| 5,282,449 A | * | 2/1994 | Takahashi et al. | 123/350 |
| 5,406,920 A | * | 4/1995 | Murata et al. | 123/399 |
| 5,429,089 A | | 7/1995 | Thornberg et al. | 123/352 |
| 6,253,546 B1 | * | 7/2001 | Sun et al. | 123/681 X |
| 6,305,350 B1 | | 10/2001 | Livshiz et al. | 123/339.11 |

FOREIGN PATENT DOCUMENTS

| | | |
|---|---|---|
| DE | 3400951 | 7/1985 |
| DE | 4305573 | 8/1994 |

OTHER PUBLICATIONS

"Load Pulse Unit", Woodward Product Specification 82388C, 1998.

*The Art of Control Engineering*, K. Dutton, S. Thompson, B. Barraclough, Addison Wesley Longman, 1997, pp. 276–283.

* cited by examiner

*Primary Examiner*—Tony M. Argenbright
(74) *Attorney, Agent, or Firm*—Jenkens & Gilchrist P.C.

(57) ABSTRACT

In an engine control system (10) for an industrial internal combustion engine (12) driving a load (14) and desired to run at constant speed as controlled by an engine control unit (16) including a governor controlling an engine throttle (18), a governing system is provided for holding the engine (12) at relatively constant speed, notwithstanding load changes, by anticipating load change with pre-set loop modification control.

13 Claims, 5 Drawing Sheets

FEEDFORWARD ENGINE CONTROL GOVERNING SYSTEM

BACKGROUND

The invention relates to industrial internal combustion engines, and more particularly to a governing system for holding the engine at constant speed.

The invention has application to various industrial internal combustion engines, including natural gas engines, diesel engines, gas turbine engines, etc. In one desirable application, the invention is used with an industrial internal combustion engine used to drive an electrical power generator for a utility, factory, or the like, preferably matching a desired frequency such as 60 Hz in the United States or 50 Hz in Europe, notwithstanding load changes. The invention has other applications where it is desired to hold the engine at some constant speed.

Industrial internal combustion engines use governors to hold the engine at a constant speed. A feedback system responds to the engine and supplies a feedback signal to the governor which compares observed speed against desired speed to generate a delta or error signal which is supplied to the engine throttle to correctively increase or decrease engine speed in an attempt to drive the delta or error signal to zero. Natural gas engines have poorer load response than diesel engines so that a large load placed on a natural gas engine may stall the engine or may result in an unacceptably low dip in engine speed. Response time is particularly important when the driven load is an electrical generator when isolated from the electric utility grid. In these applications, it is important to minimize the magnitude and duration of excursion from synchronous frequency. Relying only upon feedback necessarily requires delay because the engine speed change must first be sensed before it can be corrected.

A feedforward system provides quicker response, and can be used to anticipate engine speed changes. It is known in the prior art to sense load changes and then send an anticipation signal to the engine control unit to change throttle position before the feedback system senses a speed change. This reduces frequency excursions caused by load transients. This type of feedforward system based on load sensing to provide an anticipation signal is disclosed in "Load Pulse Unit", Woodward Product Specification 82388C, 1998.

In another feedforward system, load anticipation trim signals are provided as feedforward signals which anticipate engine response to changes in commanded engine loading. The feedforward signals are summed with the feedback system error signal to control the throttle, for which further reference may be had to Thomberg et al U.S. Pat. No. 5,429,089, incorporated herein by reference.

In another feedforward system, engine output power is allowed to rise in anticipation of increased load. In response to a load command, a small delta speed change is applied to the engine over a time interval from when the load command is first sensed. This type of feedforward system is desirable when the amount of extra torque required is not known.

SUMMARY

The present invention provides a governing system for an industrial internal combustion engine and relies upon predictively anticipating load change to maintain constant engine speed notwithstanding load changes. The amount of extra required torque is known ahead of time, at least approximately, and precise control is initiated before the extra load is actually applied. In a preferred embodiment, the invention is applicable in a PID, proportional integral differential or derivative, control loop to directly set the integral term with an update applied only once, without re-application.

DETAILED DESCRIPTION

Figure 1:
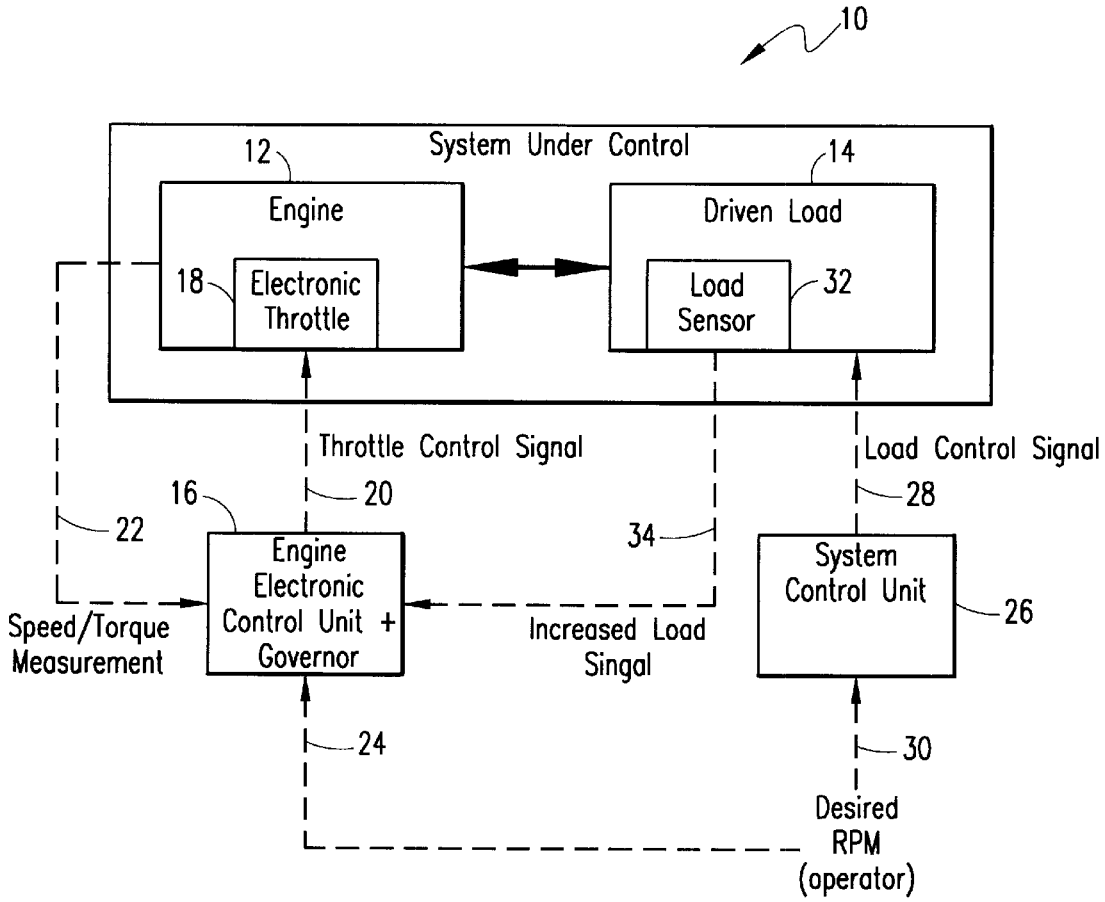
FIG. 1 (PRIOR ART)
FIG. 1 is a schematic drawing of an engine control system known in the prior art.

FIG. 1 shows an engine control system 10, known in the prior art, for an industrial internal combustion engine 12 driving a load 14 and desired to run at constant speed as controlled by an engine control unit 16 including a governor controlling an engine throttle 18 by a throttle control signal 20. A governing system is provided for holding the engine at relatively constant speed, and includes a feedback system responsive to the engine and supplying a feedback speed/torque measurement signal 22 to engine control unit 16 to enable the governor to attempt to maintain constant engine speed via throttle control signal 20 supplied to throttle 18. The operator supplies a desired speed or rpm signal at signal 24 input to engine control unit 16 which compares the actual or observed speed at 22 against the desired speed at 24, and responds to the difference or delta therebetween as an error signal to adjust throttle 18 to attempt to drive such delta or error signal to zero.

A system control unit 26 is provided for controlling load 14 via load control signal 28, and may be responsive to the desired speed or rpm set by the operator at input 30. For example, when driven load 14 is an electrical generator, a desired frequency is 60 Hz in the United States, and 50 Hz in Europe. It is known to sense load changes at load sensor 32, to provide an increased load signal at 34 to engine control unit 16 to provide load anticipation, to enable correction of throttle 18 without waiting for a difference or delta error signal between observed engine speed at 22 and desired engine speed at 24. This reduces frequency fluctuation in the electrical utility grid caused by load transients. It is also known in the prior art to provide load anticipation signals in accordance with cyclic control or collective control signals, for example the above noted incorporated U.S. Pat. No. 5,429,089.

The present invention is applicable where the magnitude of the driven load 14 is known at least approximately. The magnitude of the load can either be estimated from the power and torque requirements and inertia of the driven load 14 or measured experimentally. In the preferred embodiment, the present system directly sets an integral term in a PID, proportional integral differential or derivative, control loop, to be described, and relies upon the amount of extra required torque to be substantially or at least approximately known before it is actually needed. Precise control is achieved by modifying the integrator term only once, after which control reverts to the PID control loop, without re-application of an update term otherwise responsive to engine speed change or load change or load command signal change. This is in contrast to prior feedforward control systems where the extra amount of required torque is not known, so that the best that can be done is to allow engine power output to rise slowly in anticipation, with application of a small delta change for a calibrated time duration from the point where the speed or load or command signal change is first seen. The latter does not afford the precise control desired and accomplished by the present system. In the present invention, the governing system holds the engine at relatively constant speed, notwithstanding load changes, by anticipating load change with pre-set throttle control loop modification.

Figure 2:
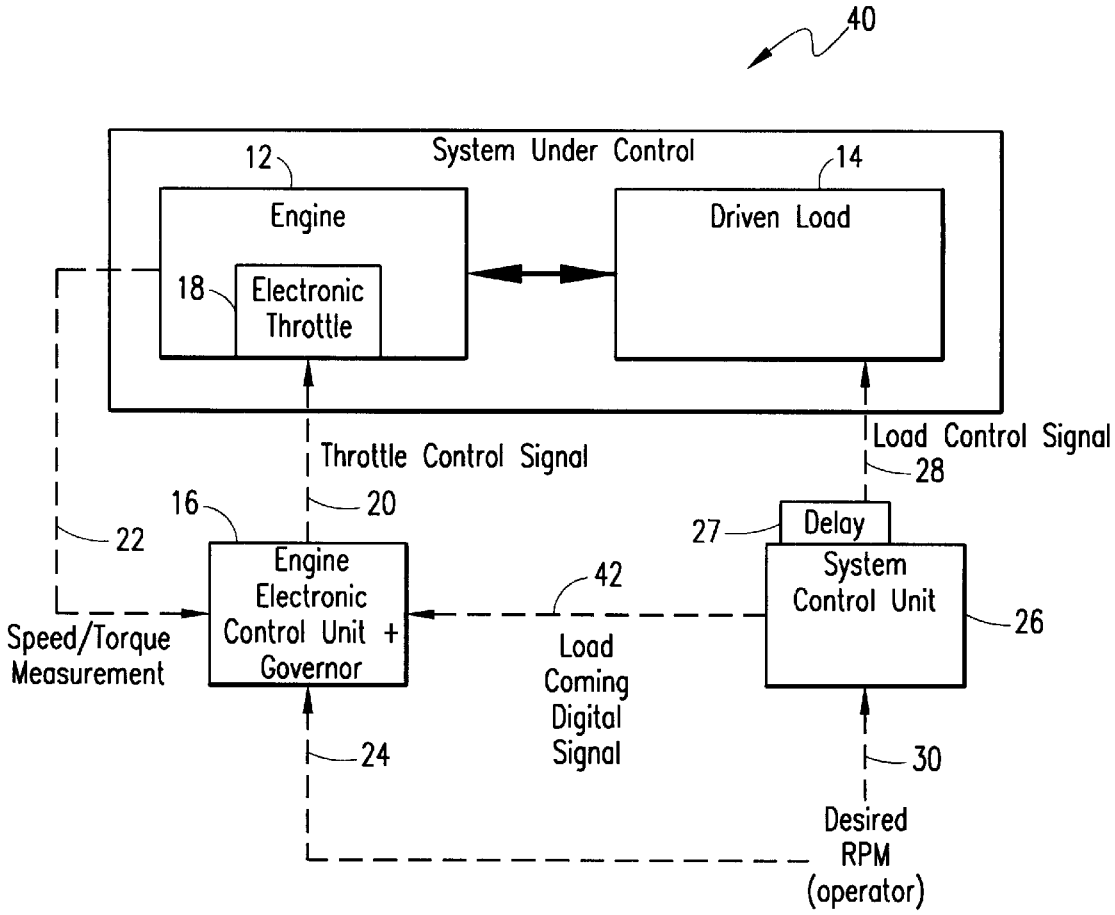
FIG. 2 is like FIG. 1 and illustrates the present invention.

FIG. 2 shows an engine control system 40 in accordance with the invention and uses like reference numerals from above where appropriate to facilitate understanding. In accordance with the present invention, the governing system holds the engine at relatively constant speed, notwithstanding load changes, by predictively anticipating load change in the above noted situation. The governing system includes a feedback system, as above, responsive to engine 12 and supplying a first input at 22 to engine control unit 16 to enable the governor to attempt to maintain constant engine speed. System control unit 26 controls load 14 and supplies a second input at 42 to engine control unit 16. First input 22 is a feedback input responsive to engine speed change after such change. Input 42 is a feedforward input anticipating engine speed change before such change in the above noted controlled situation where the load and inertia of the system are known, at least approximately, in advance. There is no need to wait for an engine speed error or delta signal nor a load sensor signal nor a load anticipation trim signal to be summed with a feedback signal. This is an advantage in the above noted situation where the amount of extra required torque is known before it is actually needed, and is utilized in the present system.

System control unit 26 has the noted input at 30, and first and second outputs at 28 and 42, respectively. Input 30 of system control unit 26 is responsive to the operator command. Output 28 of system control unit 26 is supplied to load 14 and provides the noted load control signal thereto. Output 42 of system control unit 26 is supplied to engine control unit 16 and provides a feedforward load-coming signal thereto in anticipation of load change as controlled by system control unit 26. System control unit 26 supplies feedforward load-coming signal 42 to engine control unit 16 without waiting for engine speed change and without waiting for load change. Such feedforward load-coming signal is a step change one-time-only signal preferably applied to a PID control loop to directly set the integral term, to be described. In preferred form, system control unit 26 supplies feedforward load-coming signal 42 from system control unit 26 to engine control unit 16 no later than application of load control signal 28 from system control unit 26 to load 14. Preferably, system control unit 26 sequences outputs 28 and 42 in response to the operator command at 30 such that feedforward load-coming signal 42 is supplied to engine control unit 16 a known time before load control signal 28 is applied to load 14, as provided by a known delay 27 at he noted first output of system control unit 26.

Figure 3:
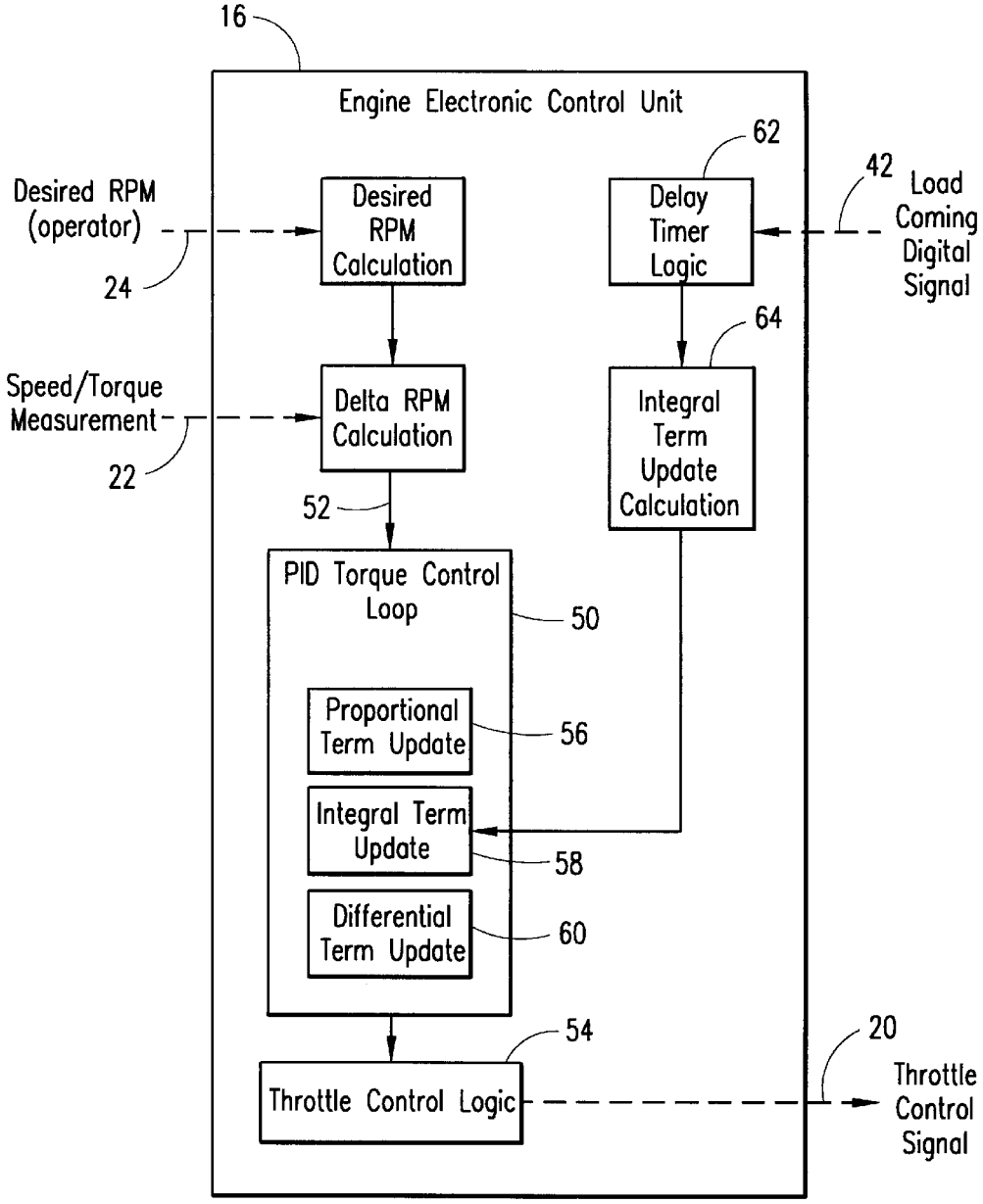
FIG. 3 schematically illustrates a portion of FIG. 2.

Engine control unit 16 preferably includes a PID, proportional integral differential or derivative, control loop 50, FIG. 3, having an input 52 from the difference between desired engine speed 24 and observed engine speed 22, and having an output at 54 providing throttle control signal 20 to engine 12. PID control loop 50 includes a proportional term 56, an integral term 58, and a differential or derivative term 60, as known in the prior art, for example *The Art Of Control Engineering,* K. Dutton, S. Thompson, B. Barraclough, Addison Wesley Longman, 1997, pages 280–282. The portion of FIG. 3 described thus far, as shown at the left half of FIG. 3, is known in the prior art, and is a typical feedback control algorithm. The proportional term 56 passes a signal proportional to the error signal, i.e. the delta or difference between desired speed or rpm and observed or actual speed or rpm. The integral term 58 is proportional to the time integral of the error signal, for averaging, to minimize overreaction to sudden peaks or valleys. The differential or derivative term 60 is proportional to the time derivative of the error signal, to provide response to rate of change of speed over time. The combination of these aspects is known in the prior art, and is preferred in the present invention for simplicity and application in accordance with known technology. In the present invention, load-coming signal 42, FIG. 2, is applied, following delayed timer logic 62, FIG. 3, as a direct update at 64 to integral term 58. Update 64 applied to integral term 58 is a predetermined set value applied only once to integral term 58, without re-application.

Figure 4:
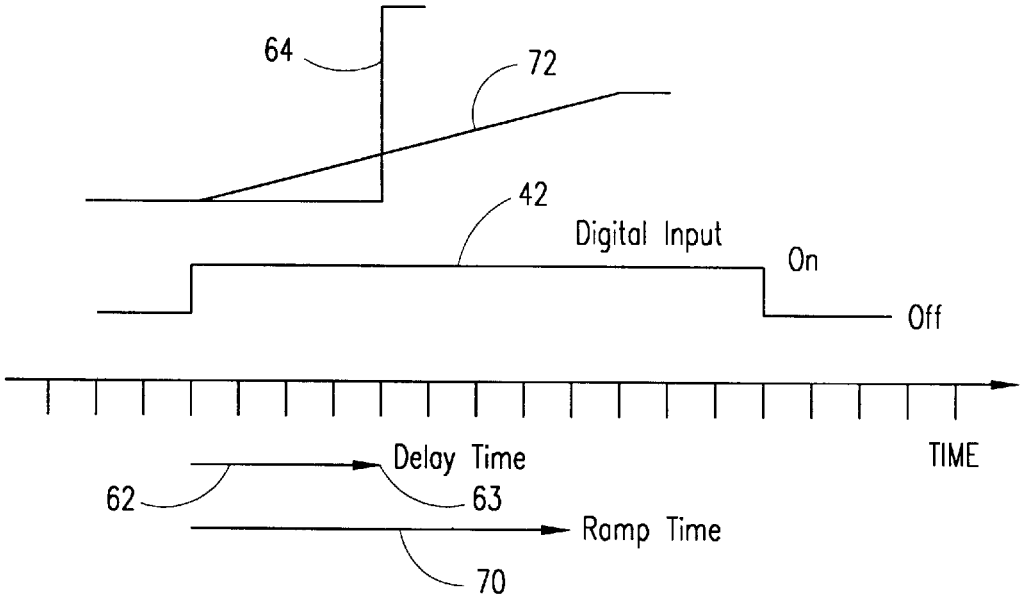
FIG. 4 schematically illustrates operation of FIG. 3.

In FIG. 4, the delay provided at 62 allows sequencing control so that the direct update signal at 64 is applied at a known time after application of the load-coming signal 42. At the end 63 of delay 62, the update is applied at 64 as a one-time-only transition, as opposed to a ramp time 70 gradually applying a delta error signal along ramp 72 as in the prior art. The transition at 64 rather than at 72 is enabled because of the noted controlled situation wherein the load and inertia are known.

Figure 5:
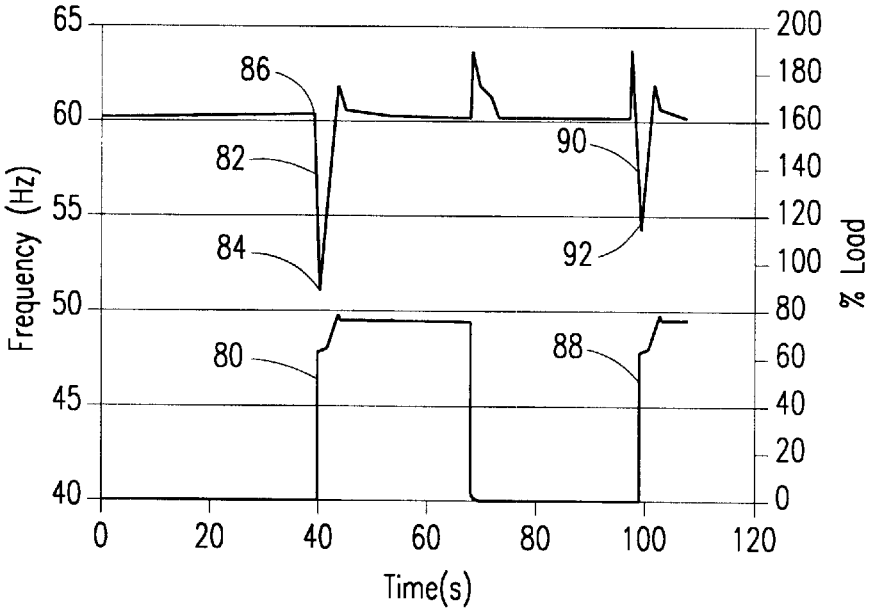
FIG. 5 is a graph showing improved performance in accordance with the invention.

FIG. 5 illustrates performance in accordance with the invention. The left vertical axis shows frequency in hertz, and the right vertical axis shows percent load change. Without the present invention, a 75% load step applied as shown at 80 to a Waukesha Engine 7044GSIE engine results in a frequency dip at 82 to 51.5 Hz at 84 from 60 Hz at 86. In comparison, with the present invention, when a 75% load step is applied at 88, the frequency dips at 90 to 54.6 Hz at 92. Without the present invention, the frequency excursion from 60 Hz is 14%. With the invention, the frequency excursion from 60 Hz is 9%. This improvement in frequency excursion is significant in electrical utility applications. The average frequency for the thirty seconds around transient 80 without the present invention is 59.5 Hz, whereas the average frequency for the thirty seconds around transient 88 with the present invention is 59.9 Hz. This differential in average frequency around a transient, with and without the invention, is significant in electrical utility applications.

Figure 6:
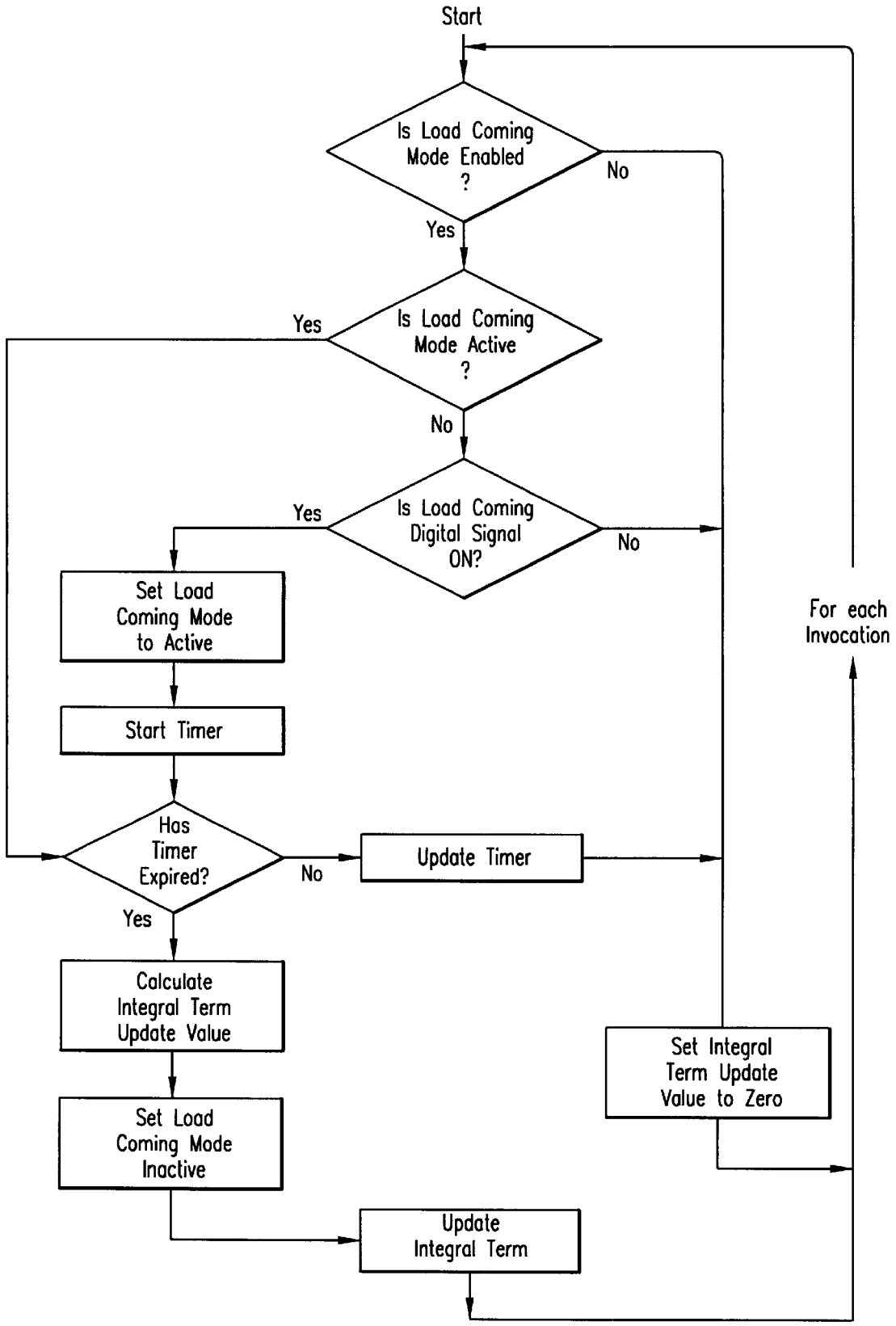
FIG. 6 is a flow chart illustrating operation of the invention.

FIG. 6 shows flow chart software and methodology in accordance with the invention. At initiation, if the load-coming mode at 42 is not enabled, then the integral term update value at 64 is set to zero, and the PID control loop proceeds as noted above. If the load-coming mode is enabled, then an enquiry is made as to whether the load-coming mode is active. If the load-coming mode is already active, then an enquiry is made as to whether the timer has expired, to be described. If the load-coming mode is not active, then an enquiry is made as to whether the load-coming signal 42 is on. If not, then the integral term update is set to zero, and the PID loop continues as above. If the load-coming signal is on, then there is a load-coming signal at 42, and the load-coming mode is set to active, which starts a timer. An enquiry is made as to whether the timer has expired, and if not, then such enquiry is updated and the integral term update is set to zero. When the timer has expired, as illustrated at 63 in FIG. 4, then the integral term update value is provided at 64, whereafter the load-coming mode is made inactive, and the integral term is updated at 58. This process is repeated for each invocation, namely each activation by system control unit 26.

It is recognized that various equivalents, alternatives and modifications are possible within the scope of the appended claims.

What is claimed is:

1. An engine control system for operating an industrial internal combustion engine at a relatively constant speed while driving a load, not withstanding load changes, by anticipating load change, said engine control system comprising:

an engine control unit including a governor controlling an engine throttle;

a feedback system responsive to said engine and supplying a first input to said engine control unit to enable said governor to attempt to maintain constant engine speed; and a system control unit for controlling said load and supplying a second input to said engine control unit, said first input being a feedback input responsive to engine speed change after such change, said second input being a feedforward input anticipating engine speed change before such change;

wherein said system control unit has an input, and first and second outputs, said input of said system control unit being responsive to an operator command, said first output of said system control unit being supplied to said load and providing a load control signal thereto, said second output of said system control unit being supplied to said second input of said engine control unit and providing a feedforward load-coming signal thereto in anticipation of load change as controlled by said system control unit.

2. The invention according to claim 1 wherein said system control unit supplies said feedforward load-coming signal from said second output of said system control unit to said second input of said engine control unit without waiting for engine speed change and without waiting for load change.

3. The invention according to claim 2 wherein said system control unit supplies said feedforward load-coming signal from said second output of said system control unit to said second input of said engine control unit no later than application of said load control signal from said first output of said system control unit to said load.

4. The invention according to claim 1 wherein said system control unit sequences said first and second outputs thereof in response to said operator command at said input thereof, such that said feedforward load-coming signal from said second output of said system control unit is supplied to said second input of said engine control unit a known time before said load control signal is applied from said first output of said system control unit to said load.

5. The invention according to claim 1 wherein said engine control unit includes a PID, proportional integral differential, control loop having an input from the difference between desired engine speed and observed engine speed at said first input of said engine control unit, said PID control loop having an output providing a throttle control signal to said engine, said PID control loop including a proportional term, an integral term, and a differential term, wherein said feedforward load-coming signal at said second input of said engine control unit from said second output of said system control unit is applied as an update to said integral term.

6. The invention according to claim 5 wherein said update applied to said integral term is a predetermined set value applied only once to said integral term, without re-application.

7. A method for controlling an industrial internal combustion engine driving a load and desired to run at constant speed as controlled by an engine control unit including a governor controlling an engine throttle through a control loop, comprising holding said engine at relatively constant speed notwithstanding load changes by anticipating load change with pre-set control loop modification, providing a feedback system responsive to said engine and supplying a first input to said engine control unit to enable said governor to attempt to maintain constant engine speed, providing a system control unit for controlling said load and supplying a second input to said engine control unit, providing said first input as a feedback input responsive to engine speed change after such change, providing said second input as a feedforward input anticipating engine speed change before such change, and providing said system control unit with an input, and first and second outputs, supplying said input of said system control unit responsive to an operator command, supplying said first output of said system control unit to said load as a load control signal, supplying said second output of said system control unit to said second input of said engine control unit as a feedforward load-coming signal thereto in anticipation of load change, and controlling said feedforward load-coming signal by said system control unit.

8. The method according to claim 7 comprising supplying said feedforward load-coming signal from said second output of said system control unit to said second input of said engine control unit without waiting for engine speed change and without waiting for load change.

9. The method according to claim 8 comprising supplying said feedforward load-coming signal from said second output of said system control unit to said second input of said engine control unit no later than application of said load control signal from said first output of said system control unit to said load.

10. The method according to claim 7 comprising sequencing said first and second outputs of said system control unit in response to said operator command at said input of said system control unit, by supplying said feedforward load-coming signal from said second output of said system control unit to said second input of said engine control unit a known time before applying said load control signal from said first output of said system control unit to said load.

11. The method according to claim 7 comprising providing said engine control unit with a PID, proportional integral differential, control loop, providing said PID control loop with an input from the difference between desired engine speed and observed engine speed at said first input of said engine control unit, providing said PID control loop with an output supplying a throttle control signal to said engine, providing said PID control loop with a proportional term, an integral term, and a differential term, and applying said feedforward load-coming signal at said second input of said engine control unit from said second output of said system control unit as an update to said integral term.

12. The method according to claim 11 comprising applying said update to said integral term as a predetermined set value.

13. The method according to claim 11 comprising applying said update only once to said integral term, without re-application.

* * * * *

UNITED STATES PATENT AND TRADEMARK OFFICE

CERTIFICATE OF CORRECTION

PATENT NO. : 6,564,774 B2
DATED : May 20, 2003
INVENTOR(S) : Michael Ellims et al.

It is certified that error appears in the above-identified patent and that said Letters Patent is hereby corrected as shown below:

Column 3,
Line 60, replace “he” with -- the --

Signed and Sealed this

Seventh Day of October, 2003

JAMES E. ROGAN
*Director of the United States Patent and Trademark Office*